United States Patent [19]

Wedler et al.

[11] Patent Number: 5,008,989

[45] Date of Patent: Apr. 23, 1991

[54] SAFETY BELT BUCKLE

[75] Inventors: Peter Wedler, Bütlingen; Peter Eckmann, Hamburg, both of Fed. Rep. of Germany

[73] Assignee: Autoflug GmbH & Co. Fahrzeugtechnik, Rellingen, Fed. Rep. of Germany

[21] Appl. No.: 415,026

[22] Filed: Sep. 29, 1989

[30] Foreign Application Priority Data

Oct. 1, 1988 [DE] Fed. Rep. of Germany ..... 3833483

[51] Int. Cl.[5] ..... A44B 11/26

[52] U.S. Cl. ..... 24/641; 24/633; 24/645

[58] Field of Search ..... 297/468; 24/633, 636, 24/637, 640, 641, 645, 651

[56] References Cited

U.S. PATENT DOCUMENTS 4,624,034 11/1986 Ishiguro et al. ..... 24/636 X
4,870,726 10/1989 Eksell et al. ..... 24/636

FOREIGN PATENT DOCUMENTS 3533684 2/1987 Fed. Rep. of Germany ..... 24/633
WO88/06012 8/1988 PCT Int'l Appl. ..... 24/633

*Primary Examiner*—James R. Brittain
*Attorney, Agent, or Firm*—Robert W. Becker & Associates

[57] ABSTRACT

In a belt buckle for safety belts, particularly in motor vehicles, for receiving and locking an insertable tongue having a housing and, arranged therein, an insertion path for the insertable tongue, with the path containing a spring-loaded ejector, and having a locking element which is pivotably mounted in the buckle and, in the locked position, engages in the tongue recess and is secured in the locked position via a securing member movably mounted in the buckle, and having a slidable actuator for releasing the locking element, which is guided in the housing transversely with respect to the plane of movement of the locking element and which, to protect it from shock, cooperates with a counterweight guided in the housing, the intention is to simplify the construction of the buckle for the purpose of shock prevention and reduce the mass of the parts which cooperate in the event of acceleration of the buckle. For this purpose, the counterweight cooperates directly with the securing member and secures it against release of the locking element in the event of forces of acceleration acting on the buckle parts.

17 Claims, 4 Drawing Sheets

SAFETY BELT BUCKLE

BACKGROUND OF THE INVENTION

The invention relates to a buckle for receiving and locking an insertable tongue of a safety belt, for example in a motor vehicle.

It has been proposed to provide a safety belt buckle having a housing and, arranged therein, an insertion path for the insertable tongue, said path containing a spring-loaded ejector, and having a locking element which is pivotably mounted in the buckle and, in the locked position, engages in a recess of the tongue and is secured in the locked position by means of a securing member movably mounted in the buckle, and for releasing the locking element, having a sliding knob which is guided in the housing transversely with respect to the plane of movement of the locking element which, to protect it from shock, cooperates with a counterweight guided in the housing.

A belt buckle of this kind is described in DE-OS 35 33 684 Krützfeldt et al dated Feb. 26, 1987 and belonging to the assignee of the present invention; in an embodiment by way of example shown therein, the counterweight is separately arranged and mounted on bearings in the buckle housing and is connected by a special lever to the sliding knob and the securing member for the locking element, so that, disadvantageously, there is only an indirect cooperation of the counterweight with the sliding knob on the one hand and the securing member on the other hand. Apart from the complicated buckle structure which can be regarded as a further disadvantage, the masses which are to be moved or which are to be secured against movement in the event of forces of acceleration acting on the buckle are comparatively great, since a number of buckle components are involved in the operational coupling of the sliding knob, securing member and counterweight.

It is therefore an object of the present invention to improve the belt buckle of the aforementioned general type in such a way that the structure of the buckle is simplified with regard to the means for protecting it from shock, and the mass of the components that cooperate during acceleration is reduced.

SUMMARY OF THE INVENTION

According to the invention there is provided a buckle for receiving and locking an insertable tongue of a safety belt, comprising a housing, an insertion path for the insertable tongue arranged in the housing and provided with a spring-loaded ejector, a locking element pivotable to a locked position in which it engages the tongue, a movably mounted securing member for securing the locking element in the locked position, a slidable actuator for releasing the locking element and guided in the housing transversely with respect to the plane of movement of the locking element, and a counterweight guided in the housing and arranged to cooperate directly with the securing member to prevent it from releasing the locking element in response to forces of acceleration acting on the buckle parts.

In one advantageous embodiment by way of example, the counterweight and slidable actuator are both directly coupled to the securing member in an interlocking manner; in another embodiment the securing member is movably mounted in a plane parallel to the plane of insertion of the safety belt tongue and is acted upon by the counterweight which is movably guided in its plane of movement.

In the first embodiment, there is a first lever arm between the pivot axis of the securing member and the connection of the slidable actuator to the securing member, and a second lever arm between the pivot axis and the connection of the counterweight to the securing member; the pivot axis of the securing member and the masses of the slidable actuator and counterweight are selected in such a way that, in the event of forces of acceleration acting on the buckle, moments of equal magnitude are produced, with the result that, in the event of forces of acceleration occurring in the direction of the path of movement of the slidable actuator, the moments exerted by the counterweight and by the slidable actuator on the securing member are of equal magnitude and oppose each other.

According to an advantageous embodiment within the framework of this first embodiment by way of example, it is envisaged that the slidable actuator and securing member and the securing member and counterweight should in each case be coupled together in an interlocking manner by means of hinge-like arrangements, while the counterweight and slidable actuator, at a spacing from each other, act on opposite ends of the securing member and are guided in oppositely directed paths of movement. This ensures that the moments exerted by the slidable actuator or by the counterweight in the event of acceleration are opposed by a countermoment of equal magnitude, so that even under the effect of forces of acceleration acting in the direction of movement of the slidable actuator and counterweight, the securing member is guaranteed to maintain its resting position in which the locking element is secured.

Another embodiment by way of example of the invention relates to an arrangement in which the securing member is movably mounted in a plane parallel to the plane of insertion of the safety belt tongue and is acted upon by the counterweight which is movably guided in its plane of movement between the slidable actuator and an abutment on the securing member, while the securing member is preferably constructed to resemble a pair of scissors, whereby there are two pivoting securing members rotatably mounted about a common support pin, these pivoting securing members each acting upon the locking element with a front securing portion and being connected at their rear ends by a tension spring, so that, in their resting position, a closing moment is produced. Between the slidable actuator and the pivoting securing members there is movably mounted a counterweight which is constructed so that its mass is at least equal to that of the slidable actuator, this counterweight urging the pivoting securing members into the securing position in the presence of forces of acceleration acting accordingly with the same inertia force with which the slidable actuator seeks to move the securing members into the release position. Consequently, the securing members remain in their securing position even under the effect of forces of acceleration.

According to a preferred embodiment, the securing portions of the pivoting securing members are urged into their securing position, at their ends facing the slidable actuator, by the counterweight which is springbiased against the slidable actuator.

In order to secure the pivoting securing members still further, blocking elements may be mounted in the buckle housing which project into the path of insertion for the counterweight and, when the counterweight is removed from the pivoting securing members, take over the function of securing the securing members so that these scissor-like securing members cannot swing outwardly and release the locking element of the buckle.

BRIEF DESCRIPTION OF THE DRAWINGS

Two preferred embodiments of the invention will now be described by way of example and with reference to the accompanying drawings, in which.

DESCRIPTION OF PREFERRED EMBODIMENTS

Figure 1:
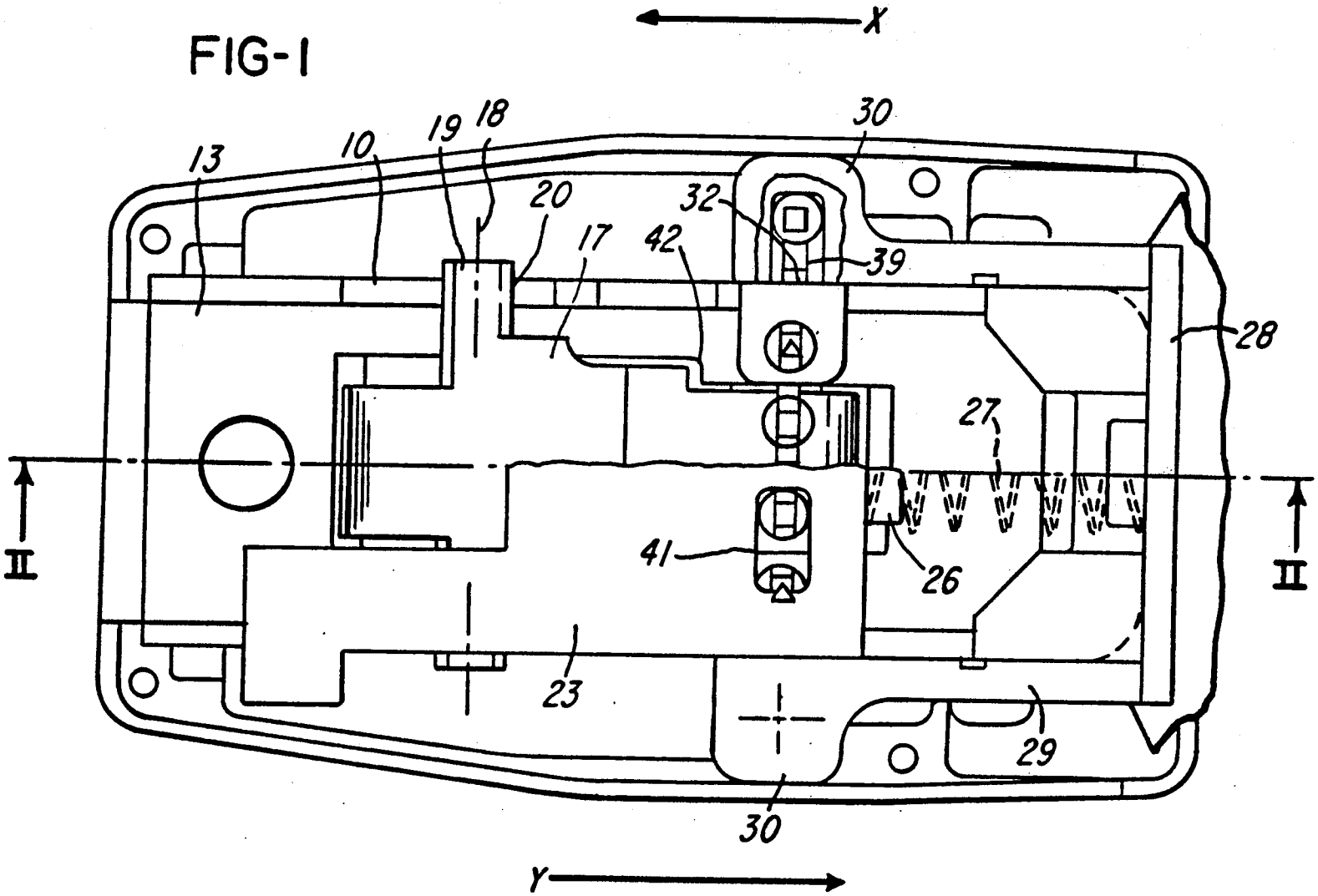
FIG. 1 is a plan view of a belt buckle with counterweight.
Figure 2:
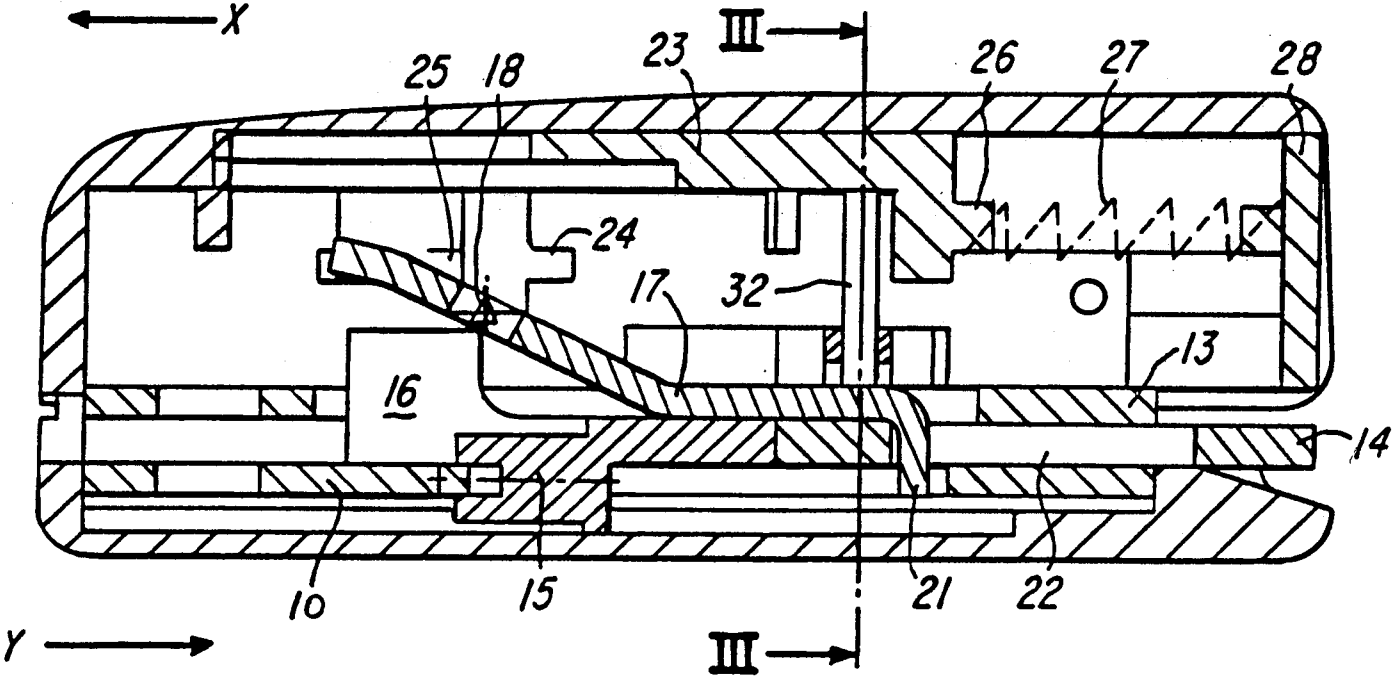
FIG. 2 is the buckle shown in FIG. 1 in longitudinal section on the line II—II in the locked position.
Figure 3:
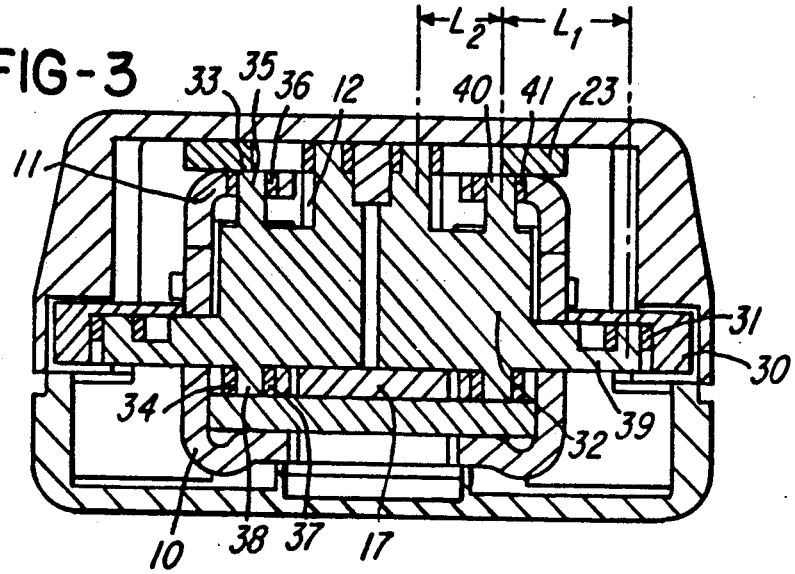
FIG. 3 shows the buckle in section on the line III—III of FIG. 2.

In the embodiment shown in FIGS. 1 to 3, the buckle has a C-shaped housing 10 with bent portions 11 bent inwards at its upper end and a central recess 12 located between them. Anchored in the buckle housing at a spacing from the base of the buckle is a second buckle plate 13 which defines a path of insertion for a buckle tongue 14. Guided in spring-loaded manner in the path of insertion is an ejector 15 which has at its rear end an actuating lug 16.

In the buckle housing 10, a hook-shaped locking element 17 is pivotably mounted about an axis 18 by means of lateral projections 19 which engage in corresponding recesses 20 in the side walls of the housing 10. The locking element 17 engages through the second buckle plate 13 and has a projection 21 which latches, in its locking position, in a recess 22 of the buckle tongue 14.

On the upper side of the housing 10 a counterweight 23 is guided in a longitudinally movable manner along the buckle by means of guides 25 engaging in lateral recesses 24 in the housing 10 and at its front end it has a projecting spring cam 26 on which a spring 27 is supported against a slidable actuator in the form of a sliding knob 28 guided on the buckle.

The sliding knob 28 is in turn guided in a longitudinally movable manner by means of flanges 29 running along the outside of the housing 10; the flanges 29 terminate in thickened portions 30 which contain a groove 31 extending transversely with respect to the direction of movement.

A securing member 32 for securing the locking element 17 in the locking position is pivotably mounted, specifically in bearing points 33, 34, in the vertical plane of the buckle. The upper bearing point 33 is formed by the engagement of projections 35 in bores 36 in the bent portion 11 of the C-shaped buckle housing 10, and the lower bearing point 34 is formed by bores 37 in the second buckle plate 13, into which projections 38 of the securing member 32 engage. To improve their supporting function, the bores 36, 37 are lined with injection mouldings of e.g. plastic.

In the embodiment shown in FIGS. 1 to 3, the counterweight 23 and securing member 32 are divided in the longitudinal direction of the buckle, i.e. in a single plane there are two securing members 32 and two counterweights 23 which are correspondingly mounted in the housing 10, 13 and operatively coupled to the associated parts.

Each securing member 32 has a lateral projection 39 passing through the lateral arm of the buckle housing 10 and is mounted, at its outer end, in the groove 31 of the sliding knob guide 29, 30, so that a positive connection is obtained between the sliding knob 28 and the securing member 32 such that longitudinal movement of the sliding knob 28 will cause the securing members 32 to pivot about the axis formed by the bearing points 33. At their upper ends the securing members 32 engage with a pin 40 through the central recess 12 of the housing 10 and thus engage in a lower groove 41 arranged on the counterweights 23, so that a positive connection is also obtained between the counterweights 23 and the securing members 32, so that in the event of movement of the counterweights 23 the securing members will pivot about the axis formed by the bearing points 34.

With respect to the plane formed by the upper bearing point 33 and the lower bearing point 34 of the securing members 32, the positive or interlocking connections between the sliding knob and securing members and between the counterweights and securing members are arranged so that the connection between the sliding knob 28 and each securing member 32 has a lever arm $1_1$ and the connection between each counterweight 23 and the associated securing member 32 has a lever arm $1_2$ (FIG. 3).

The method of operation of the buckle shown in FIGS. 1 to 3 will now be described, both in terms of the locking and release procedures of the buckle and also with respect to the forces of inertia produced in the event of acceleration acting on the buckle.

The description starts from the locking position of the buckle shown in the drawings. To open the buckle, pressure exerted on the sliding knob 28 causes a moment to be exerted on the securing members 32 via the sliding knob guide 29, 30 as a result of the interlocking connection via the lateral projections 39, so that the securing members 32 rotate about the upper bearing points 33. Because of the interlocking connection of the securing members 32 to the counterweights 23 via the pins 40, the counterweights 23 move in the opposite direction to the movement of insertion of the sliding knob 28. The securing members 32 thus release the locking element 17, which is rotated by the ejector 15 into the opening position about the rotation spindle or axis of rotation 18. The locking element 17 comes to rest in the open position on the actuating lug 16 of the ejector 15 and in this position the securing members 32 are prevented from pivoting back. Since the sliding knob 28 is connected to the securing members 32 in its direction of movement because of the interlocking connection therewith, the sliding knob 28 remains in its rear position when the buckle is released.

In order to lock the buckle, the buckle tongue 14 is pressed into the buckle, counter to the force of the ejector spring (not shown) between the base of the buckle and the second buckle plate 13 and thereby pushes the ejector 15 backwards. The actuating lug 16 releases the locking element 17 which pivots about the spindle 18 into the locking position in which the projection 21 of the locking element engages in the buckle tongue recess 22. This also releases the securing members 32 which now rotate about the upper bearing points 33 under the effect of the spring 27, biasing the counterweights 23 and the sliding knob 28 against each other, and move into their securing position as shown in FIG. 2.

If the buckle is now subjected to load as a result of pulling of the belt at the buckle tongue 14, the locking element 17 with its projection 21 holds the buckle tongue 14 in place and rests with its lateral projections 19 in the recesses 20 in the buckle housing 10. A second point of support is an associated edge 42 of the associated recess in the upper buckle plate 13 by means of which the locking element 17 engages with the buckle plate 13. In this position, the locking element 17 is secured by the securing members 32 which are guided, by means of their lateral projections 39, in the lateral arms of the buckle housing 10 in such a way that vertical displacement of the securing members 32 and consequent release of the locking element 17 are out of the question.

If the buckle is now accelerated in the longitudinal direction of the buckle, for example if the buckle is accelerated in the direction x during a tightening operation (FIGS. 1 and 2), the sliding knob 28 lags behind the acceleration of the buckle as a result of its inertia, so that the sliding knob is moved in the opposite direction of movement y. As a result of the interlocking connection of the sliding knob 28 to the securing member 32, a closing moment is exerted on the securing members 32 via the lever arm $1_1$, these securing members 32 being held about the upper bearing points 33 in the direction y.

The counterweights 23 undergo the same acceleration and also lag behind the buckle acceleration acting in the direction x, although the counterweights 23 with the lever arm $1_2$ exert an opening moment about the lower bearing points 34 of the securing members 32, because this moment seeks to tilt the securing members 32 in the direction of opening thereof.

Since the moments acting on the securing members 32 are directed towards one another and are of the same magnitude because of the lever arms $1_1$ and $1_2$ selected and because of the associated masses of the sliding knob 28 and counterweights 23, the moments acting in the direction x in the event of acceleration of the buckle cancel each other out, with the result that the securing members 32 retain their securing position relative to the locking element 17. If, after the tightening acceleration has occurred, the buckle is decelerated on reaching its end position, an acceleration component acting in the direction y (FIGS. 1 and 2) occurs, with the result that the sliding knob 28 now performs an opening movement as a result of its inertia, as has already been described in connection with the releasing operation of the buckle. Just as described above, the moment which has the effect of opening the securing members 32 is opposed by a closing moment applied by the counterweights 23, so that even in this condition of acceleration the moments cancel each other out so that the securing members 32 thus remain unchanged in their securing position with respect to the locking element 17.

A particular advantage of this embodiment is also the fact that, in the event of suddenly fluctuating accelerations of the buckle body, the locking of the buckle is not affected because the components involved in the locking are firmly coupled together and thus the parts are prevented from coming open as a result of vibration.

FIGS. 4 to 8 show another embodiment by way of example of a belt buckle with counterweight in which, where possible and appropriate, the same or similar buckle parts have been given the same reference numerals as in the embodiment described hereinbefore.

In the housing 10, which is U-shaped in this embodiment, an upper buckle plate 50 is provided above the buckle plate 13 which determines the path of insertion for the buckle tongue 14, while the securing masses and counterweights which will be described in more detail are arranged between the buckle plates 13 and 50.

The means for securing the locking element 17 consists in this embodiment of two pivoting securing members 51 which are pivotably mounted in the plane of the buckle plate, and which are arranged in a scissor-like configuration and secured by means of a pin 52 passing through the plates 13, 50 as the center of rotation; the center of gravity of the pivoting securing members 51 is located at their center of rotation 52. At their front ends the pivoting securing members 51 have a securing portion 53 which, in the locking position, comes to rest above the locking element 17 of the buckle and fixes and secures the locking element 17 there by means of a locking surface 54. At their free rear end the pivoting securing members 51 are joined together by a tension spring 55 in such a way that the scissor-like pivoting securing members 51 are spring-loaded into their securing position shown in FIG. 4 and are retained in this position.

On the inside of the buckle the sliding knob 28 has a flange 61 which, when the sliding knob 28 is moved along, engages between the rear ends of the pivoting securing members 51 and forces them apart so that the locking elements 53 of the pivoting securing members 51 are pressed outwards and move away from the locking surfaces 54 of the locking element 17.

Between the buckle plates 13 and 50, the counterweight 23 is guided; this counterweight 23 has two external fingers 56 acting on the one hand on rear abutments 57 of the securing portions 53 of the pivoting securing members 51 and on the other hand is acted upon by compression springs 58 supported between the sliding knob 28 and the counterweight fingers 56, these compression springs 58 urging the counterweight 23, 56 towards the abutments 57 on the securing portions 53 and hence urging the pivoting securing members 51 into their securing locking position.

Figure 7:
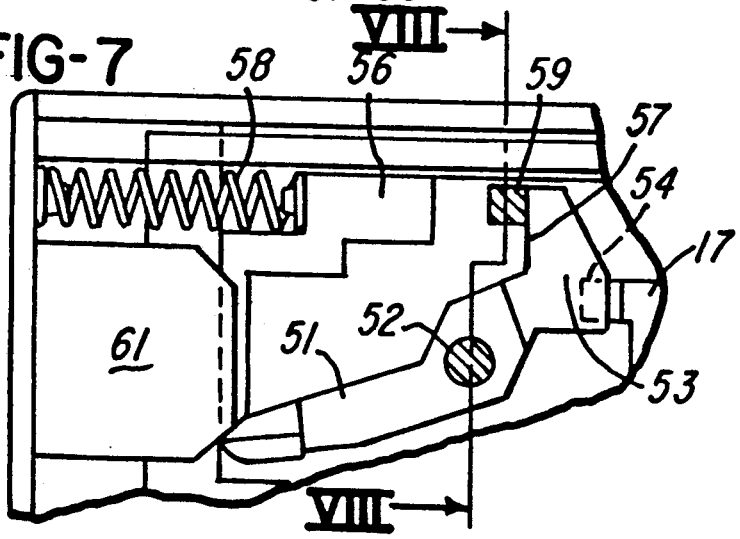
FIG. 7 shows a partial view of the buckle during acceleration in the direction x corresponding to FIG. 4.
Figure 8:
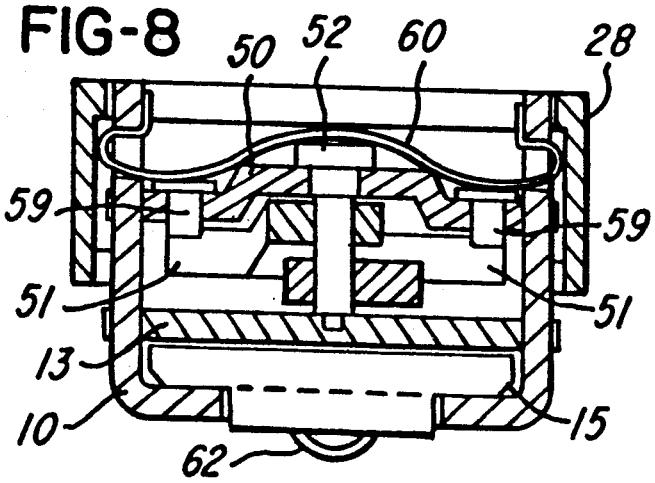
FIG. 8 is a section on the line VIII—VIII of FIG. 7.

As is clear particularly from FIGS. 7 and 8, blocking elements 59 are mounted in the upper buckle plate 50, which extend through the buckle plate 50 into the path of movement of the fingers 56 of the counterweight 23 and are forced into the blocking position by means of a leaf spring 60 supported on the side walls of the buckle housing 10. The blocking elements 59 are arranged so that they also cooperate with the abutments 57 of the securing portions 53 of the pivoting securing members 51 and hold them in the locking position even when the fingers 56 of the counterweight 23 have moved away from the abutments 57.

The method of operation of the buckle parts in the embodiment described above will now be described in the same way as the embodiment corresponding to FIGS. 1 to 3.

Figure 4:
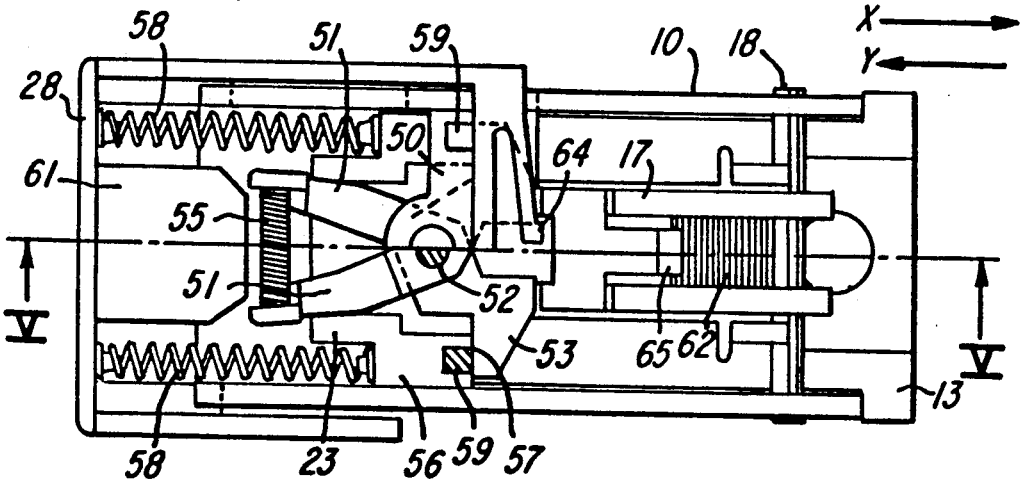
FIG. 4 shows another embodiment by way of example of the buckle, in plan view and in the locked position.
Figure 5:
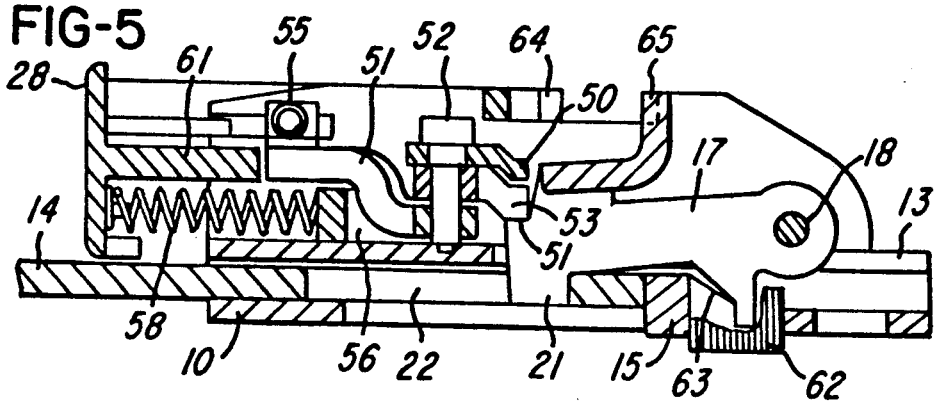
FIG. 5 shows the buckle according to FIG. 4 in longitudinal section on the line V—V in FIG. 4.

FIGS. 4 and 5 show the buckle in the locked position with the buckle tongue inserted. To achieve this, the buckle tongue 14 is pushed into the path formed by the base of the housing 10 and the lower buckle plate 13. The ejector 15 is pressed backwards counter to the spring force of an ejector spring 62, while the ejector 15, via a slope 63, pivots the locking element 17 into its locking position in which its projections 21 engage in the recess 22 of the buckle tongue 14. As a result of this tilting movement of the locking element 21, the pivoting securing members 51 pressed outwardly in the released position are freed, so that they close up like a pair of scissors under the action of the tension spring 55 and rest with their securing portions 53 on the locking surfaces 54 of the locking element 17 and the locking element 17 is thus secured against any accelerations occurring in the longitudinal direction of the buckle. The closing of the pivoting securing members 51 is aided by the fingers 56 of the counterweight 23 acting on the rearward abutments 57 of the securing portions 53, these fingers 56 being brought into contact with the securing portions 53 of the pivoting securing members 51 by the compression springs 58 and biasing these securing members into the locking position in accordance with FIG. 1.

Figure 6:
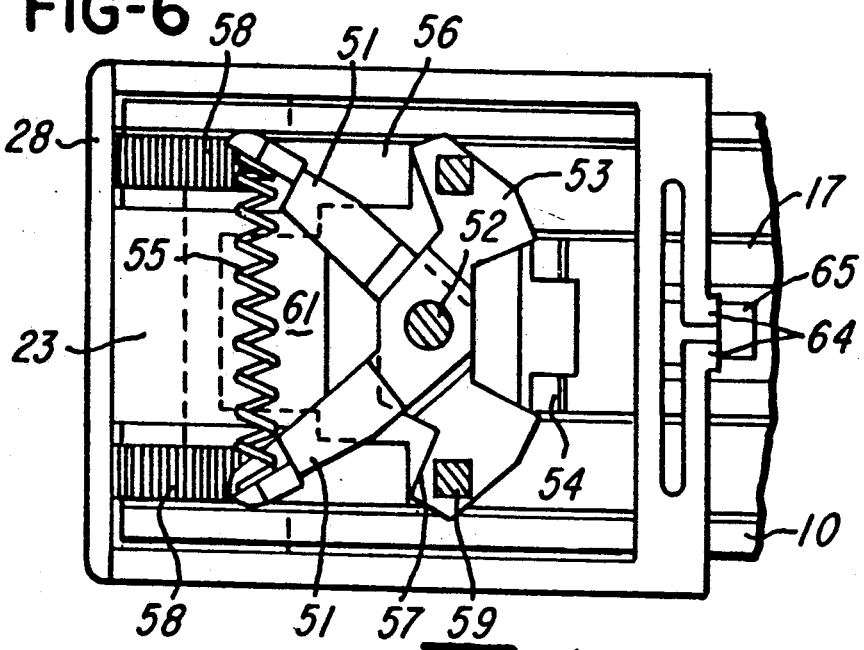
FIG. 6 shows the buckle according to FIG. 4 in the released position.

If the belt buckle is to be released by actuation of the sliding knob 28, the sliding knob 28 is pressed into the interior of the buckle and the flange 61 thus engages between the rear parts of the pivoting securing members 51 and forces them apart, overcoming the force of the tension spring 55. As a result of the opening of the pivoting securing members thus effected, the fingers 56 of the counterweight 23 are pushed backwards counter to the force of the spring 58. The securing portions 53 of the pivoting securing members 51 release the locking element 17, so that the sliding knob 28 can now press against an upwardly positioned end 65 of the locking element 17 by means of a cam 64 and pivot it into the open position (FIG. 6).

If the buckle is accelerated in the direction x (FIG. 4) during the tightening of part of the safety belt connected to the buckle, the sliding knob 28 as well as the counterweight 23, 56 lag behind the movement of the other parts of the buckle as a result of their inertia. The sliding knob 28 cannot really move during this acceleration because it is fixed in the housing; the counterweight 23, 56, however, frees itself from the abutment 57 of the securing portions 53 of the pivoting securing members 51, overcoming the force of the spring 58.

In spite of the absence of an effect from the compressive forces of the counterweight 23, 56, the securing position of the securing members 51 is maintained, since they are biased in the locking position by the tension spring 55. However, in order to ensure safe locking even under the effect of laterally acting transverse acceleration, the blocking elements 59 mounted in the upper buckle plate 50 now slide downwards, under the action of leaf spring 60, into the path of movement of the fingers 56 of the counterweight 23 which have freed themselves from the abutments 57 of the securing portions 53 and thus take over the function of securing the pivoting securing members 51, as the blocking elements 59 now prevent the pivoting bolts 51 from opening even under the effect of lateral transverse accelerations, as is clear in particular from FIGS. 7 and 8.

As the tightening operation is ended, the buckle now undergoes negative acceleration in direction y (FIG. 4) as already described and at the same time the counterweight 23, 56 acted upon by the springs 58 is accelerated towards the abutments 57 of the securing portions 53 of the pivoting securing members 51 and travels towards the blocking elements 59, which are provided for cooperating in this case with approach slopes directed towards the fingers 56 of the counterweight 23. Thus, as they move, the fingers 56 of the counterweight 23 lift the blocking elements 59, move them out of engagement with the pivoting securing members 51 and themselves take over the task of securing the pivoting securing members 51 in the manner shown in FIG. 4.

During the acceleration in the direction y, the sliding knob 28 travels in the same direction as the counterweight 23, moves with the flange 61 between the ends of the pivoting securing members 51 and thus exerts an opening action on the pivoting securing members 51. Since, however, the counterweight 23, 56 has a mass as least as great as that of the sliding knob 28 and the counterweight 23 is subjected to a force of acceleration equal to that of the sliding knob 28, the counterweight 23 persistently counteracts the opening of the sliding knob 28, so that, by cancelling out the forces of inertia acting on both sides, the pivoting securing members 51 are held and secured in their locking and securing position.

In this embodiment by way of example, the additional blocking elements 59 also take over the job of additionally safeguarding the securing position of the pivoting securing members 51 in so far as, after the end of the tightening operation, in practice, it is frequently impossible to define a clear direction of acceleration, but rather there is a very rapid fluctuation between high acceleration and deceleration values in the x and y directions. Because of this, the directions of movement of the movable buckle parts in the form of the sliding knob 28 and counterweight 23 may be superimposed, so that the synchronization of the movements, which has been described in idealized form, may be disrupted. However, since, in the event of any such synchronization disorder, the additional blocking elements 59 immediately move into their blocking position which secures the pivoting securing members 51 when the fingers 56 of the counterweight 23 are moved away from the securing portions 53 of the pivoting securing members 51, the locking element 17 will be reliably secured by the pivoting securing members 51 in any circumstances of movement.

The present invention is, of course, in no way restricted to the specific disclosure of the specification and drawings, but also encompasses any modifications within the scope of the appended claims.

What we claim is:

1. A buckle for receiving and locking an insertable tongue of a safety belt, comprising:

a housing in which is provided an insertion path for said insertable tongue;

a spring-loaded ejector;

a pivotably mounted locking element that, in a locked position, engages a recess of said tongue;

securing member means movably mounted in said housing and serving for securing said locking element in said locked position thereof; and a slidable actuator that is guided in said housing transverse to a plane of movement of said locking element and serves to release same, with said locking element, to protect it from acceleration shocks, cooperating with counterweight means guided in said housing, whereby said counterweight means cooperates with said securing member means to prevent release of said locking element in response to acceleration forces that act on buckle parts;

said slidable actuator and said counterweight means being disposed in said housing in such a way that they are spaced from one another and act upon respective portions of said securing member means for urging the same in opposite directions, with said slidable actuator and said counterweight means each being coupled with said securing member means in an interlocking manner.

2. A buckle for receiving and locking an insertable tongue of a safety belt, comprising:

a housing in which is provided an insertion path for said insertable tongue;

a spring-loaded ejector;

a pivotably mounted locking element that, in a locked position engages a recess of said tongue;

securing member means movably mounted in said housing and serving for securing said locking element in said locked position thereof; and a slidable actuator that is guided in said housing transverse to a plane of movement of said locking element and serves to release same, with said locking element, to protect it from acceleration shocks, cooperating with counterweight means guided in said housing, whereby said counterweight means cooperates with said securing member means to prevent release of said locking element in response to acceleration forces that act on buckle parts;

said slidable actuator and said counterweight means being disposed in said housing in such a way that they are spaced from one another and act upon respective portions of said securing member means for urging the same in opposite directions, with said slidable actuator and said counterweight means each being coupled with said securing member means in an interlocking manner by a coupling;

said housing being C-shaped and having upper portions and a central recess; a buckle plate disposed in said housing; and said securing member means being pivotably mounted in said upper portions of said housing and in associated recesses in said buckle plate, with said securing member means being provided with lateral projections that extend through said housing above said buckle plate, and also being provided with pin means extending beyond said housing through said central recess thereof.

3. A buckle according to claim 2, which includes respective hinge-like arrangements for effecting said interlocking coupling between said slidable actuator and said securing member means and between said securing member means and said counterweight means.

4. A buckle according to claim 2, in which said housing includes guide means for said counterweight means, with said guide means being provided with a clearance for movement of said counterweight means opposite to the direction of actuation of said slidable actuator.

5. A buckle according to claim 2, in which said slidable actuator is coupled with said securing member means via first groove means that receive said lateral projections, and said counterweight means is coupled with said securing member means via second groove means that receive said pin means.

6. A buckle according to claim 2, in which: the connection between said slidable actuator and said securing member means is disposed at a first distance from a plane defined by bearing points of said securing member means; the connection between said counterweight means and said securing member means is disposed at a second distance from said plane defined by said bearing points of said securing member means and said first and second distances as well as the masses of said slidable actuator and said counterweight means are such that when acceleration forces act on buckle parts, equally great moments act on said securing member means.

7. A buckle according to claim 6, which includes a spring disposed between said counterweight means and said slidable actuator to bias same relative to one another.

8. A buckle for receiving and locking an insertable tongue of a safety belt, comprising:

a housing in which is provided an insertion path for said insertable tongue;

a spring-loaded ejector;

a pivotably mounted locking element that, in a locked position, engages a recess of said tongue;

securing member means movably mounted in said housing and serving for securing said locking element in said locked position thereof: and a slidable actuator that is guided in said housing transverse to a plane of movement of said locking element and serves to release same, with said locking element, to protect it from acceleration shocks, cooperating with counterweight means guided in said housing, whereby said counterweight means cooperates with said securing member means to prevent release of said locking element in response to acceleration forces that act on buckle parts;

said slidable actuator and said counterweight means being disposed in said housing in such a way that they are spaced from one another and act upon respective portions of said securing member means for urging the same in opposite directions, with said slidable actuator and said counterweight means each being coupled with said securing member means in an interlocking manner; and in a longitudinal direction of said buckle, two counterweights disposed in the same plane, and two securing members disposed in the same plane, with each of said securing members being coupled with said slidable actuator.

9. A buckle for receiving and locking an insertable tongue of a safety belt, comprising:

a housing in which is provided an insertion path for said insertable tongue;

a spring-loaded ejector;

a pivotably mounted locking element that, in a locked position, engages a recess of said tongue;

securing member means movably mounted in said housing and serving for securing said locking element in said locked position thereof; and a slidable actuator that is guided in said housing transverse to a plane of movement of said locking element and serves to release same, with said locking element, to protect it from acceleration shocks, cooperating with counterweight means guided in said housing, whereby said counterweight means cooperates with said securing member means to prevent release of said locking element in response to acceleration forces that act on buckle parts;

said securing member means being provided with abutment means; said securing member means being movably disposed in a plane that is parallel to the plane of insertion of said safety belt tongue; and said securing member means being acted upon by said counterweight means, which is movably guided in a plane of movement between said slidable actuator and said abutment means of said securing member means.

10. A buckle according to claim 9, in which said securing member means comprises two securing members that are disposed in the manner of a pair of scissors and are pivotably mounted about a common support pin, with each of said securing members having a front securing portion that in a closed position of said securing members acts on said locking element, and with ends of said securing members remote from said securing portions thereof being connected by spring means that biases said securing members into said closed position.

11. A buckle according to claim 10, in which said spring means is a tension spring.

12. A buckle according to claim 10, in which each of said securing portions is provided with an abutment surface on a side thereof that faces said slidable actuator, with each of said abutment surfaces being acted upon into a securing position by said counterweight means, which is spring-loaded relative to said slidable actuator.

13. A buckle according to claim 10, in which disposed in said housing is a blocking element that projects into the path of movement of said counterweight means, is spring-loaded into its blocking position, and holds said securing portions of said securing members in the locked position.

14. A buckle according to claim 13, in which said housing is U-shaped and has a lower buckle plate that defines said insertion path for said safety belt tongue, as well as at a distance therefrom an upper buckle plate in which said blocking element is guided and supported, with said securing members and said counterweight means being disposed between said lower and upper buckle plates.

15. A buckle according to claim 13, in which said blocking element is provided with an approach slope on a portion thereof that faces said counterweight means.

16. A buckle according to claim 10, in which the masses of said slidable actuator and said counterweight means correspond to one another.

17. A buckle according to claim 10, in which the mass of said counterweight means is greater than the mass of said slidable actuator.

* * * * *